US012269087B2

(12) United States Patent
Whitton et al.

(10) Patent No.: US 12,269,087 B2
(45) **Date of Patent: *Apr. 8, 2025**

(54) SYSTEMS AND METHODS OF BONDING WAX

(71) Applicant: Chromalloy Gas Turbine LLC, Palm Beach Gardens, FL (US)

(72) Inventors: James Whitton, East Burke, VT (US); Zachary Oras, Riverview, FL (US); Zachary Hopkins, San Diego, CA (US)

(73) Assignee: Chromalloy Gas Turbine LLC, Palm Beach Gardens, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/777,092

(22) Filed: Jul. 18, 2024

(65) Prior Publication Data

US 2024/0367220 A1 Nov. 7, 2024

Related U.S. Application Data

(63) Continuation of application No. 18/041,759, filed as application No. PCT/US2022/075422 on Aug. 24, 2022.

(60) Provisional application No. 63/260,524, filed on Aug. 24, 2021.

(51) Int. Cl.
*B22C 7/02* (2006.01)

(52) U.S. Cl.
CPC ..... *B22C 7/02* (2013.01)

(58) Field of Classification Search
CPC ..... B22C 7/02; B22C 9/04
See application file for complete search history.

(56) References Cited

U.S. PATENT DOCUMENTS

| | | | |
|---|---|---|---|
| 7,448,434 | B2 | 11/2008 | Turkington et al. |
| 8,082,972 | B1 | 12/2011 | Phipps |
| 2004/0167270 | A1 | 8/2004 | Chang et al. |
| 2008/0216984 | A1 | 9/2008 | Bolton |
| 2016/0288201 | A1 | 10/2016 | Bullied et al. |
| 2018/0272452 | A1 | 9/2018 | Clark et al. |
| 2020/0101526 | A1 | 4/2020 | Niane et al. |
| 2024/0189887 | A1 | 6/2024 | Whitton et al. |

FOREIGN PATENT DOCUMENTS

WO 2019122797 A1 6/2019

OTHER PUBLICATIONS

Extended European Search Report, dated Nov. 29, 2023, received in European Patent Application No. 22854457.3, 7 pages.

(Continued)

*Primary Examiner* — Kevin P Kerns
*Assistant Examiner* — Steven S Ha
(74) *Attorney, Agent, or Firm* — AVEK IP, LLC

(57) ABSTRACT

Lost wax casting bonding methods and systems. A method for bonding a wax component in a feeder system for a lost wax casting process comprises embedding conductive nanoparticles in wax to form a sacrificial susceptor. The method includes coupling the wax component to another component such that the sacrificial susceptor is at an interface of the wax component and the other component. The method comprises inductively heating the sacrificial susceptor to cause the wax of the sacrificial susceptor and at least a portion of wax of the wax component to melt to thereby form a bond between the wax component and the other component.

20 Claims, 7 Drawing Sheets

(56) References Cited

OTHER PUBLICATIONS

International Search Report and Written Opinion, dated Nov. 15, 2022, 7 pages, issued in International Application No. PCT/US2022/075422.

Prasad Ram: "Progress in Investment Castings", Science and Technology of Casting Processes, Malur Srinivasan, Sep. 26, 2012, XP055904957, DOI: 10.5772/50550.

FIG. 1 – PRIOR ART

FIG. 2 – PRIOR ART

SYSTEMS AND METHODS OF BONDING WAX

CROSS REFERENCE TO RELATED APPLICATIONS

This application is a continuation of U.S. patent application Ser. No. 18/041,759, filed on Feb. 15, 2023, and set to issue as U.S. Pat. No. 12,042,846 on Jul. 23, 2024, which is the national phase of, and claims priority to, International Application No. PCT/US2022/075422, filed Aug. 24, 2022, which claims priority to U.S. Provisional Patent Application 63/260,524, filed Aug. 24, 2021. The disclosure of each of these applications is incorporated by reference in its entirety herein.

FIELD OF THE DISCLOSURE

The disclosure relates generally to the field of lost wax casting. More specifically, the disclosure relates to systems and methods for bonding wax components in a lost wax casting process using susceptors and induction heating.

SUMMARY

In an embodiment, a method for bonding a wax component in a feeder system for a lost wax casting process comprises embedding conductive nano-particles in wax to form a sacrificial susceptor. The method includes coupling the wax component to another component such that the sacrificial susceptor is at an interface of the wax component and the other component. The method comprises inductively heating the sacrificial susceptor to cause the wax of the sacrificial susceptor and at least a portion of wax of the wax component to melt to thereby form a bond between the wax component and the other component.

In another embodiment, a method for bonding a wax component in a feeder system for a lost wax casting process comprises embedding conductive nano-particles in wax to form a sacrificial susceptor. The method includes coupling the wax component to another component such that the sacrificial susceptor is at an interface of the wax component and the other component. The method comprises heating the sacrificial susceptor to cause the wax of the sacrificial susceptor and at least a portion of wax of the wax component to melt to thereby form a bond between the wax component and the other component.

In still another embodiment, a system for bonding a wax component in a feeder system for a lost wax casting process comprises a plurality of sacrificial susceptors each comprising conductive nano-particles and wax. The system has a plurality of runners and supports, each of which is configured to be coupled to the feeder system. The system includes a robot comprising an inductive heating system. Each of the plurality of runners and supports has associated therewith at least one of the plurality of sacrificial susceptors.

BRIEF DESCRIPTION OF THE SEVERAL VIEWS OF THE DRAWINGS

Illustrative embodiments of the present disclosure are described in detail below with reference to the attached drawing figures.

DETAILED DESCRIPTION

Lost wax (or investment) casting process for casting metal objects has been known in the art for thousands of years. Today, the lost wax process is used in numerous industries to cast a variety of objects, such as jewelry, dentistry crowns, sculptures and other artwork, et cetera. The lost wax process is particularly well suited for precisely casting metal parts having complex shapes and high melting temperatures, such as blades or vanes of gas turbine engines.

A turbine engine part, e.g., a blade, may be cast using the lost wax process as follows. A core representing the hollow interior of the turbine blade to be cast may be created using ceramic and/or other desirable materials, and the core may be situated in a metal tool or die. Wax is then injected into the die and around the core, thus producing a wax pattern representing the blade to be cast. The wax pattern may closely mimic the metal blade to be cast, but in wax form (i.e., the size, shape, and features of the wax blade and the metal blade to be cast may be generally identical). A similar process may be used to produce wax patterns of other gas turbine components such as turbine vanes and shrouds or blade air seals. The wax pattern, and the core encompassed by the wax pattern, may then be dipped in a ceramic bath or "slurry," and a mold for pouring in metal may be formed. This mold may then be pulled out of the slurry and allowed to dry. The dipping and drying process may be repeated a number of times until a mold capable of undergoing the casting process is formed. Next, the wax may be melted out of the mold to create a cavity for the metal. For example, the mold may be situated in a furnace, a steam-dewax autoclave, or heated by other means to cause the wax to melt out of the mold. The melting and displacement of the wax may create a space between the ceramic core on the inside and the ceramic shell on the outside into which metal, e.g., a metal alloy, may be poured. Metal may be melted and poured into the mold and the mold may be cooled in a variety of manners. Once the metal has cooled, the shell material may be knocked off the metal (using a hammer, a high-pressure water blast, a vibratory table, et cetera). Finally, the core inside the metal blade may be removed by placing the metal blade in a caustic solution to dissolve or leach the core from the casting. The cast product, a (rough) blade or vane with a hollow interior in this example, may thus be formed. The cast part may then undergo additional processes (e.g., may be machined, drilled, coated, et cetera) to form the final blade usable in a gas turbine.

Figure 1:
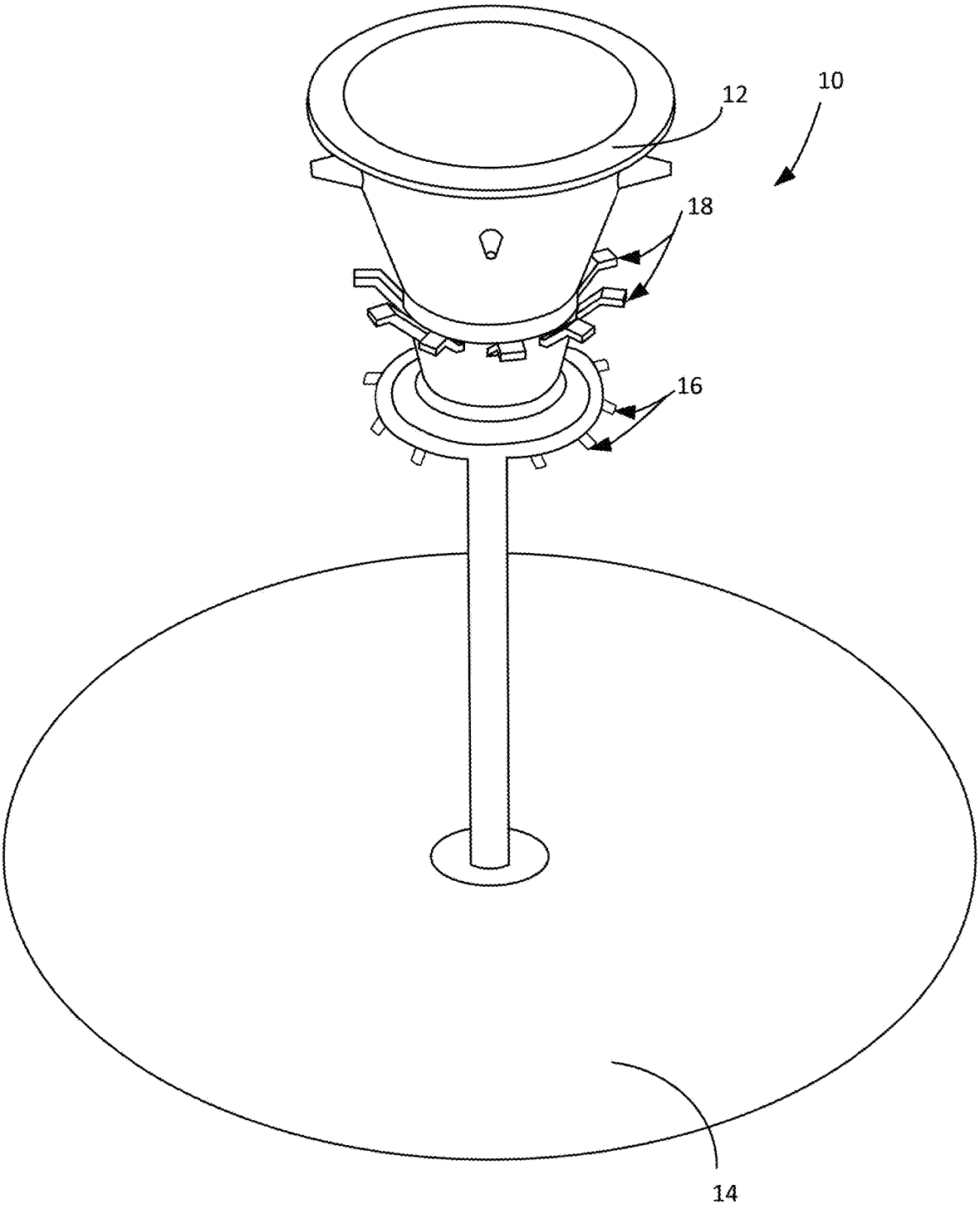
FIG. 1 is a perspective view of a PRIOR ART feeder system for a lost wax casting process, in an initial configuration.

As can be seen, the investment casting process is a multi-step process. To improve efficiencies, multiple turbine engine parts (e.g., blades, vanes, et cetera) may be cast together using a feeder system. FIG. 1 shows a prior art feeder system 10 in an initial configuration (i.e., prior to the wax components being configured thereon). The example feeder system 10 may be used for simultaneously casting a plurality of turbine blades. The arrangement of the various components of the feeder system 10, including of the wax components thereof, may be critical to the blades to be cast (e.g., may affect the crystal structure of the metal castings).

In brief, the feeder system 10 may comprise a cup 12 and a bottom plate 14. The feeder system 10 may have a plurality of outlets 16, that may be equidistantly arranged around the cup 12. Metal may be poured into the cup 12 and this molten metal may eject out the outlets 16. The feeder system 10 may also have a plurality of supporting members 18 arranged equidistantly around the cup 12. The supporting members 18, as discussed herein, may allow for the wax patterns of the feeder system 10 to be structurally supported.

Figure 2:
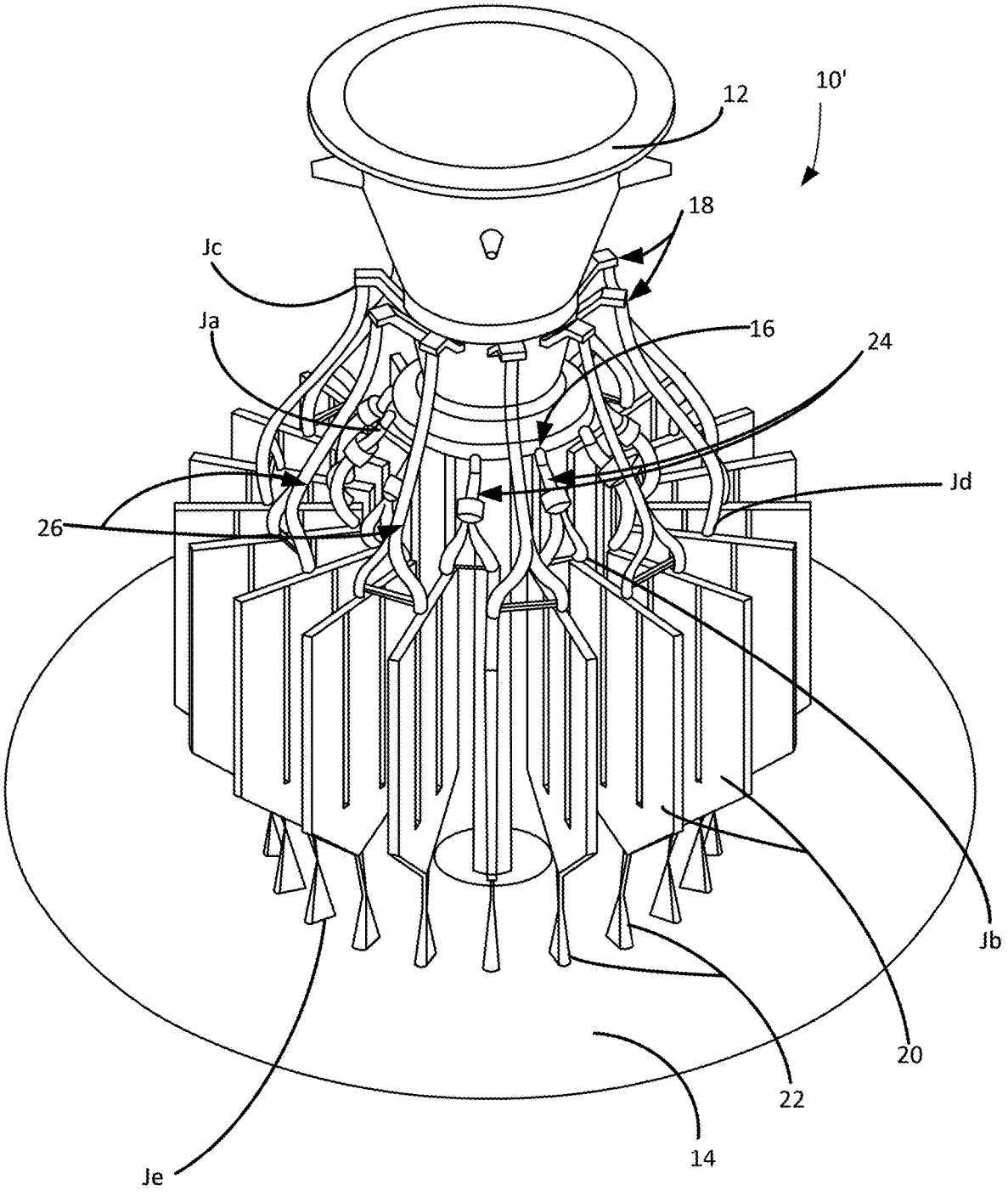
FIG. 2 is a perspective view of the PRIOR ART feeder system of FIG. 1 in an intermediate configuration.

FIG. 2 shows the feeder system (or assembly or "tree") 10 in an intermediate configuration 10' (i.e., after the wax components have been arranged on the feeder system but before the feeder system is dipped in a slurry). As can be seen, wax patterns 20, each of which may include a wax blade 22 representing a blade to be cast, may be arranged around the plate 14. Each wax blade 22 may represent a separate blade to be cast in metal. The plate 14 may have openings and/or markings (not expressly shown) to indicate where each wax pattern 20 and wax blade 22 is to be situated on the plate 14.

Each wax pattern 20 may be coupled to the cup 12 via a runner 24. Specifically, one end of each runner 24 may be coupled to an outlet 16, and at least one opposing end of each runner 24 may be coupled to a wax pattern 20. As shown, a runner 24 may be coupled to one outlet 16 and two (or more) wax patterns 20. The runners 24 represent pathways for molten metal that will subsequently be poured into the cup 12 to form the blades to be cast, as discussed herein.

Each wax pattern 20 may further be coupled to a supporting member 18 via a support 26. Specifically, one end of each support 26 may be coupled to the supporting member 18, and at least one opposing end of each support 26 may be coupled to a wax pattern 20. In embodiments, a support 26 may be coupled to one supporting member 18 and one (or more) wax patterns 20. The supports 26 may provide structural support to the wax patterns 20.

The wax patterns 20 (including the wax blades 22 thereof), the runners 24, and the supports 26 may each be formed of wax. Once the wax patterns 20, the runners 24, and the supports 26 are configured as desired, the entire feeder system or tree in the intermediate configuration 10' may be dipped into the slurry to form the mold. After the mold solidifies, the mold may be situated in the furnace to melt out the wax as described herein. Once the wax melts out, the construction of the feeder system 10' may be complete. Molten metal may now be poured into the cup 12. The molten metal 12 may flow out the cup 12 through the outlets 16 and into the voids created by the runners 16 that have now been melted out. The molten metal may eventually reach the space previously occupied by the wax patterns 20 and the wax blades 22. Thus, metal blades whose shape and features are identical to those of the wax blades 22 may be formed. As will be understood, at this point, the metal blades may be coupled to the metal that has taken the place of the wax patterns 20, which may in turn be coupled to the metal that has taken the place of the runners 24. These metal parts may be cut off, leaving the metal blades. The metal blades may then be dipped in a caustic solution to dissolve or leach the core, leaving thus the (rough) cast blades. In this way, a plurality of turbine blades may be cast at the same time.

The process of assembling the wax patterns 20, wax runners 24, and wax supports 26 on the feeder system 10 (as shown in FIG. 2) is a labor-intensive process. In the prior art, each wax pattern 20 is arranged on the plate 14 by hand. Each wax runner 24 is manually coupled to the outlet 16 and the wax patterns 20. Each wax support 26 is likewise coupled to the supporting member 18 and the wax patterns 20 by hand. As can be appreciated, depending on the number of parts being cast, the process of precisely configuring the patterns 20, the runners 24, and the supports 26 on the feeder system 10 may be cumbersome.

Moreover, substantial time and effort may have to be spent to ensure the various connection points or joints are suitable for use. Specifically, each runner 24 may be joined to least one outlet 16 via a joint Ja, and each runner 24 may be joined to at least one wax pattern 20 via a joint Jb. Similarly, each support 26 may be joined to at least one supporting member 18 via a joint Jc, and each support 26 may be joined to at least one wax pattern by a joint Jd. Further, each wax blade 22 may be joined to the plate 14 by a joint Je. In the prior art, a technician may manually create each of these joints Ja, Jb, Jc, Jd, and Je using molten wax.

Care must be taken to ensure that the joints (and especially the joints in locations where metal will subsequently flow (e.g., joints Ja, Jb, and Je)) are smooth and continuous. If the joint surfaces are not smooth and continuous, e.g., have a nook, cranny, crevice, or other imperfection, when the feeder 10 is dipped into the slurry to form the mold, the ceramic shell material may get into this imperfection in the joint and form a thin ceramic component. This thin ceramic component may disturb the flow of molten metal that is subsequently flowed through the cup 12. Considering that gas turbine parts have to be precisely cast, such a discontinuity in the wax joint may ultimately lead to the cast blade being unfit for operation. The unsatisfactory blade may thus have to be rejected. Blades may also be rejected because the joints are askew, resulting in misaligned parts. Such defects in the joints may thus add to the cost, time, and labor it takes to cast a set of operational turbine parts.

The technician may be forced to expend undue effort to decrease the likelihood of parts having to be rejected because of imperfect joints in the feeder system. Typically, the technician has to use an eye dropper, a paint brush, or other such device to apply fine layers of molten wax to the joint to ensure that a smooth surface is formed and parts are adequately sealed. This, of course, may be painstaking. Even with all this manual and time-intensive labor, because handcrafted wax joints are not perfectly repeatable and are inherently prone to include imperfections, a substantial number of the cast blades may have to be rejected because of deficiencies in the molten metal feed process. It may be desirable to automate the process of configuring the wax components (i.e., the wax patterns 20, wax blades 22, runners 24, and supports 26) in the feeder system 10. It may be particularly beneficial to automate the formation of the joints (e.g., one or more of joints Ja, Jb, Jc, Jd, and Je) such that they are repeatable, i.e., are consistently smooth and continuous, so that cast blades do not have to be rejected because of imperfect joints, inconsistent grain structure, or out of tolerance metal thicknesses.

Figure 3:
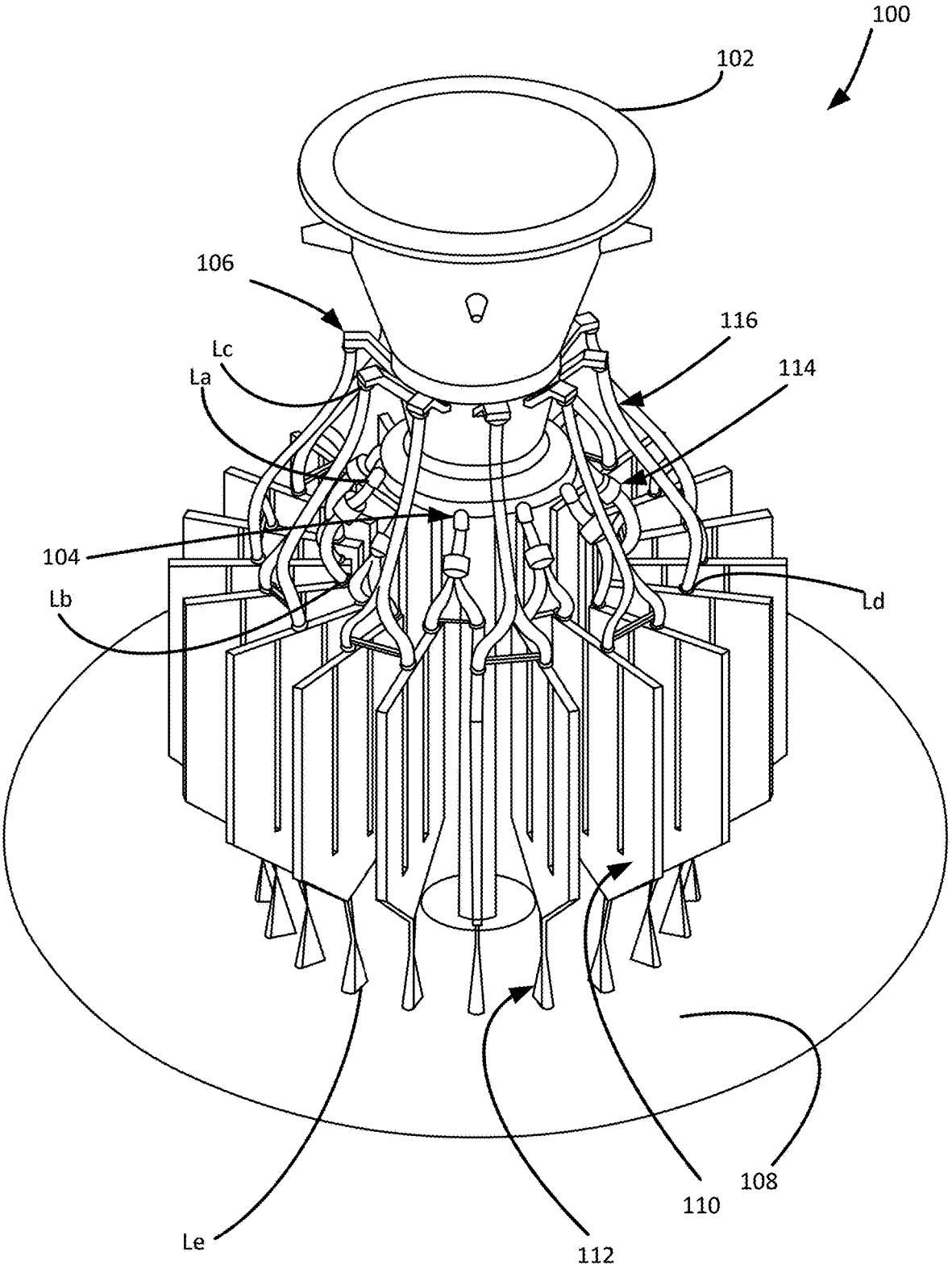
FIG. 3 is a perspective view of a feeder system for a lost wax casting process in an intermediate configuration, according to an embodiment of the present disclosure.

Focus is directed now to FIG. 3, which shows a feeder system 100 in line with the teachings of the present disclosure. As discussed herein, the wax components of the feeder system may be configured using automated processes. The feeder system 100 shown in FIG. 3 is in the intermediate configuration—i.e., is ready to be dipped in slurry for the formation of the mold. Once the mold is formed, the wax may be melted out, and metal may be poured in the feeder system 100 to cast the blades.

The feeder system 100 may include a cup 102, outlets 104, supporting members 106, and a base plate 108. The feeder system 100 may likewise include wax components, i.e., wax patterns 110, wax blades 112, runners 114, and supports 116, that may subsequently be melted out by placing the system 100 in a furnace.

In more detail, a plurality of wax patterns 110 may be equidistantly arranged on the plate 108 at designated locations. Each wax pattern 110 may include a wax blade 112, whose features and shape may be identical to the metal blade being cast. The quantity and spacing of the wax patterns 110 and wax blades 112 is generally a function of blade size and plate size.

Each runner 114 may be coupled to at least one outlet 104 and at least one wax pattern 110. Further, each support 116 may be coupled to at least one supporting member 106 and at least one wax pattern 110. The supports 116 may provide structural support to the wax patterns 110. As discussed for FIGS. 1-2, once the wax patterns 110, wax blades 112, and wax runners 114 are melted out, molten metal may be fed to the cup 102 and may eject out the outlets 104 and into the voids created by the molten wax to ultimately form the metal blade.

In an embodiment, each runner 114 may be coupled to an outlet 104 via a joint (or linkage) La, and each runner 114 may be coupled to a wax pattern 110 via a joint Lb. Similarly, each support 116 may be coupled to a supporting member 106 via a joint Lc, and each support 116 may be coupled to a wax pattern 110 via joint Ld. Further, each wax blade 112 may be coupled to the plate 108 via a joint Le.

The artisan will understand from the disclosure herein that the number of joints above the wax blade 112 (i.e., the joints La, Lb, Lc, and Ld) may exceed the number of joints coupling the wax blade 112 to the plate 108 (i.e., joints Le). For example, when the example assembly 100 is configured as shown in FIG. 3 and includes twenty wax patterns 110, there may be ten joints La, twenty joints Lb, ten joints Lc, twenty joints Ld, and twenty joints Le. Thus, sixty out of the eighty joints, in this example, may be above the wax blade 112. In an embodiment, the joints La, Lb, Lc, and Ld may be configured generally the same way to increase efficiencies. And, all joints Le may be configured in the same manner. As discussed herein, configuring the joints Le differently from the remaining joints La, Lb, Lc, and Ld may reduce the risk of contamination.

Figure 4:
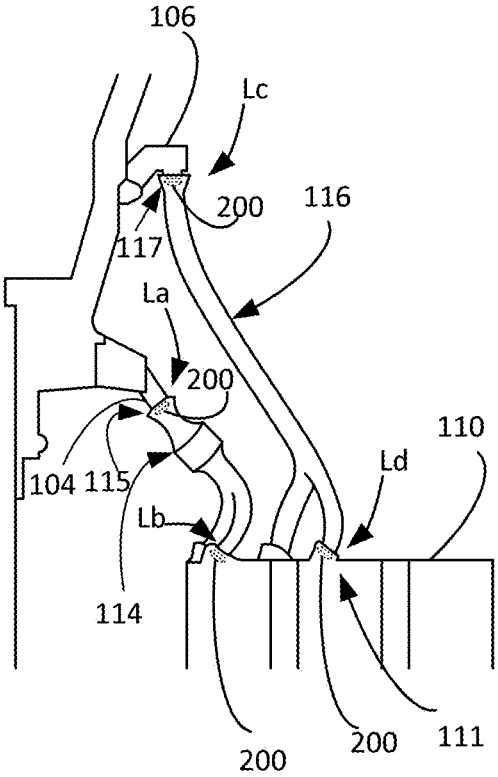
FIG. 4 is a sideview illustrating coupling between certain components of the feeder system of FIG. 3 in additional detail.

FIG. 4 shows a side view of a portion of the feeder system 100 illustrating: a joint La coupling a runner 114 to an outlet 104; a joint Lb coupling that runner 114 to a wax pattern 110; a joint Lc coupling a support 116 to a supporting member 106; and a joint Ld coupling that support 116 to the wax pattern 110. As schematically illustrated, and discussed in more detail herein, each of these joints La, Lb, Lc, and Ld may have associated therewith a sacrificial susceptor 200. The susceptors 200 shown in FIG. 4 (and FIG. 5) are in an unmolten or original state, and thus the formation of the joints La, Lb, Lc, and Ld shown in FIG. 4 is incomplete. As described below, the susceptor 200 may be inductively heated and the wax embedded therein may be melted to complete the formation of the joints La, Lb, Lc, and Ld and form the intermediate assembly 100.

The susceptors 200 may allow for the assembly of the wax components, i.e., the wax patterns 110, wax blades 112, wax runners 114, and wax supports 116 to be fully automated. By eliminating the need for a human in the formation and completion of the joints La, Lb, Lc, and Ld, the susceptors 200 may ensure these joints may be replicated exactly from one wax component (e.g., runner) to another wax component (e.g., another runner or a support), and from one assembly 100 to another. The number of rejected blades may therefore drastically decrease. Additionally, by allowing for the assembly of the wax components on the feeder system 100 to be automated, the susceptors 200 may result in valuable time savings, especially when the part being cast is a complex part that would have otherwise required extensive manual labor.

In an embodiment, each susceptor 200 may comprise one or more electrically conductive materials embedded in or otherwise mixed with wax (e.g., bonding wax such as StickTite® or another wax). For example, each susceptor 200 may comprise a ferrous metal, e.g., include a ferrous metal and a non-metal, embedded in wax. In other embodiments, each susceptor 200 may comprise a non-ferrous metal, a non-metal, and/or a combination thereof, embedded in or otherwise mixed with wax. These examples are non-limiting. The artisan will understand from the disclosure herein that the susceptor 200 may comprise any suitable material embedded in or otherwise mixed with or in contact with wax such that when the material is heated, it causes the wax to melt and flow to allow for the formation of a smooth and continuous joint. The wax material of the susceptor 200 may be referred to herein as the base or primary constituent, and the material embedded in the wax may be referred to as the working or secondary constituent.

In one currently preferred embodiment, the working constituent may comprise magnetic nanomaterials and/or nanoparticles. For example, the susceptor 200 may comprise Iron(II, III) Oxide (i.e., $Fe_3O_4$) nano-particles embedded in wax. As discussed herein, the working constituent of the susceptor 200 may be heated, e.g., inductively, using microwaves, or other means, and such heating may cause the primary constituent to melt and flow to form a smooth, continuous joint. In embodiments, inductively heating the susceptor 200 may also locally melt the parent material (i.e., the wax component(s) being joined), resulting in bonds having superior strength.

The susceptor 200 may be added at one of any number of stages of the lost wax process (e.g., may be added during the wax assembly, prior to the wax assembly, et cetera). As shown in FIG. 4, in an embodiment, each susceptor 200 may be incorporated into the wax component being joined. Specifically, each susceptor 200 may be prefabricated and may be integrated into the wax components (i.e., the wax pattern 110, runner 114, and the support 116) during injection. Such may allow for the geometry of the susceptors 200 and the joints to be tightly controlled.

Each joint La, Lb, Lc, and Ld may be a male/female joint, and the susceptor 200 may be prefabricated and embedded in the male or the female wax component. In an example, and as illustrated in FIG. 4, each wax pattern 110 may include tapered (or cup-like) depressions 111 into which the susceptors 200 are embedded, and the ends of each of the runners 114 and supports 116 may mate with the depressions 111 and rest therein to form the joints Lb and Ld, respectively. Similarly, each runner 114 may include a tapered depression 115 comprising a susceptor 200, and an end of the outlet 104 may mate with the depression 115 and rest therein to form the joint La. In like fashion, each support 116 may include a tapered depression 117 and an end of the supporting member 106 may mate therewith and rest therein to form the joint Lc. As noted, the susceptors 200 associated with the joints La, Lb, Lc, and Ld may be inductively heated to complete the formation of these joints.

Figure 5A:
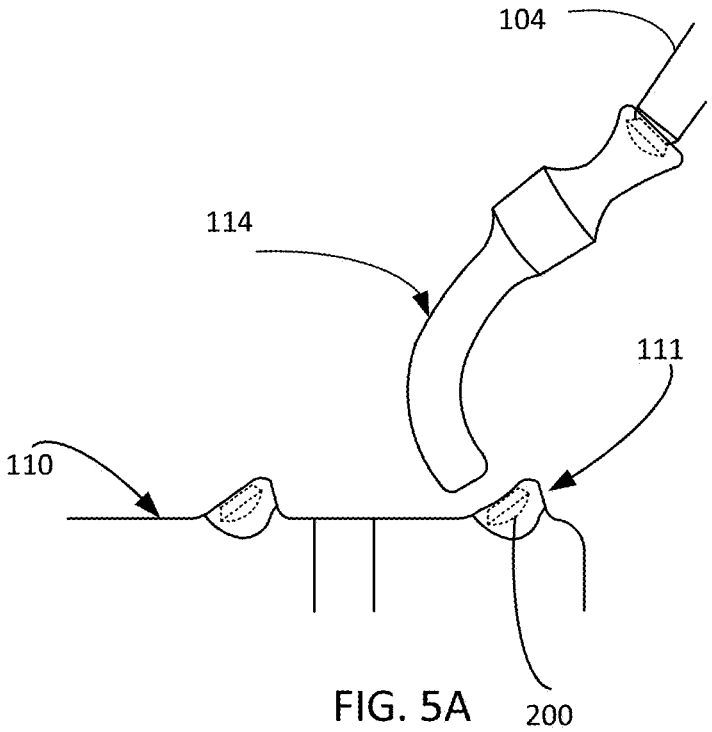
FIGS. 5A-5B are schematics illustrating a component of the feeder system of FIG. 3 being rotated into position.
Figure 5B:
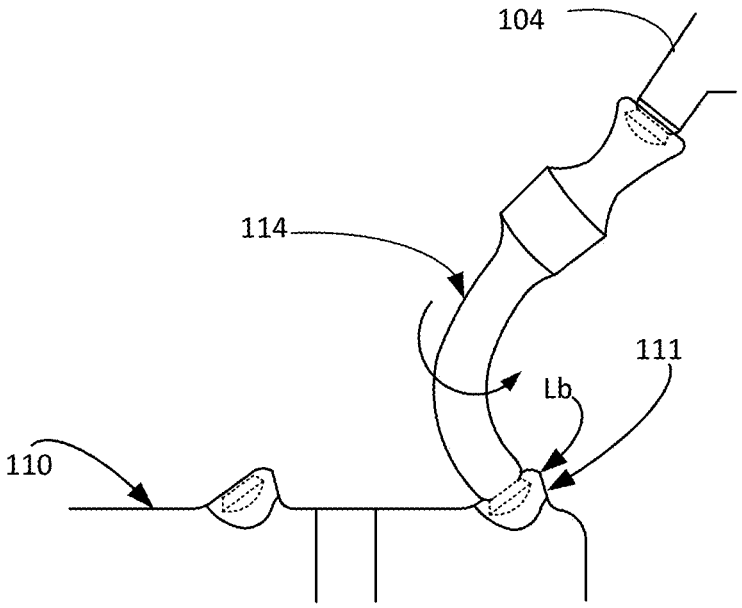

In embodiments, the runners 114 may be configured to be rotated into place to couple the runners 114 to the outlets 104 and the wax patterns 110. For example, FIG. 5A shows a runner 114 in the process of being coupled to a wax pattern 110, and FIG. 5B shows the runner 114 being rotated (in a clockwise or anti-clockwise direction) to cause an end thereof to mate with the tapered depression 111 of the wax pattern 110. The runners 114 may likewise be rotated in place to couple each runner 114 to an outlet 104. In the same way, the supports 116 may be configured to be rotated into place to couple the supports 116 to the supporting members 106 and the wax patterns 110. The requirement to rotate the runners 114 and supports 116 in place prior to the completion of the joints La, Lb, Lc, and Ld may facilitate reliable and repeatable coupling of these components.

Figure 6:
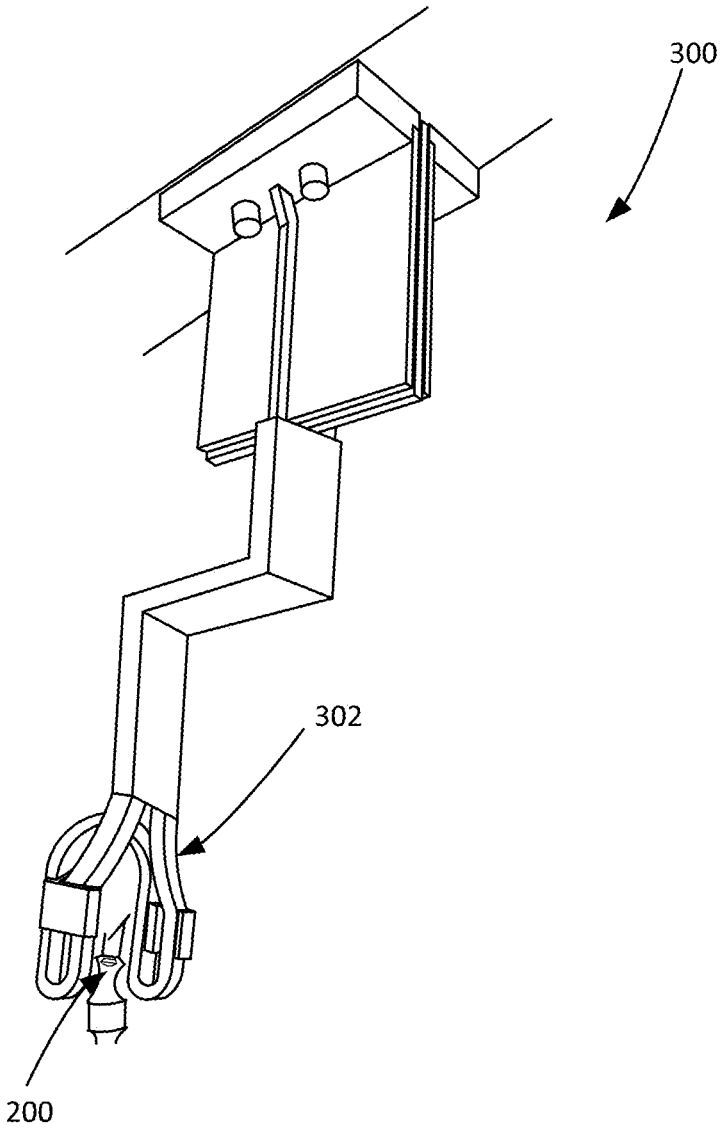
FIG. 6 is a perspective view of an example inductor usable to inductively heat susceptors of the feeder system of FIG. 3.

Once the runners 114 and the supports 116 have been rotated into position, each susceptors 200 may be inductively heated. More specifically, an inductor 300 (see FIG. 6) having a copper or other coil 302 may be situated proximate the susceptor 200 (e.g., the susceptor 200 may be situated within or partially within the coil 302 such that it does not contact the coil 302). An alternating current may be passed through the coil 302. The coil 302 may serve as the primary transformer and the working constituent of the susceptor 200 may serve as the short circuit secondary. The magnetic field generated by the inductor coil 302 may induce eddy currents within the susceptor 200. These eddy currents may flow against the electrical resistivity of the working constituent and generate precise and localized heat without any direct contact between the coil and the susceptor 200 that may disturb the wax component(s). The susceptor 200 may thus heat from the inside out and cause the wax embedded in the susceptor 200 (e.g., bonding wax) to melt and flow. The inductive heating may likewise locally melt the one or more wax components (i.e., the parent material) being joined. The melted bonding wax and melting parent material wax may mix and upon cooling form a strong bond from the inside of the joint that is smooth and continuous. Thus, when the assembly 100 is shelled after the formation of the joints La, Lb, Lc, Ld (and Le) and the metal is thereafter flowed through the cup 102, the molten metal may flow smoothly without being disturbed by any ceramic pieces that are often formed when the joint surfaces are imperfect.

In embodiments, the constitution of the susceptor 200 may be driven by a number of considerations, including one or more of bond strength, flow, and contamination.

The bond strength may be affected by the base constituent and how it reacts to the inductive heating of the working constituent. For instance, Applicant's experimentation has shown that use of RedWax, SP-983 wax, and combinations thereof as the base constituent of the susceptor generally formed aesthetically pleasing but weak bonds. StickTite®, conversely, proved to be one suitable base material into which the electrically conductive material may be embedded, in part because it formed strong bonds.

Factors that may affect the flow include particle size of the working constituent, the particle distribution of the working constituent, the particle shape of the working constituent, the weight thereof, and the percent loading of the working constituent with the base constituent. In embodiments, the working constituent may be chosen such that it leads to adequate flow of the wax, but without overheating the parts so as to obliterate or deform them. Applicant's experimentation has shown, for example, that carbon nanotubes do not serve as an optimal working constituent. While susceptors comprising carbon nanotubes may melt the wax, they may not cause the wax to flow adequately, thus impeding the formation of the joint. Fe3O4 nano-particles, conversely, when properly configured to form the susceptor 200 as discussed in more detail herein, may cause the embedded wax to flow more suitably.

Contamination considerations may dictate that that the quantity of the working constituent loaded into the base constituent be small (without unduly sacrificing inductive responsiveness). While the parts to be cast are made of metal, they may not consist of the same metal of which the working constituent is comprised. Therefore, where the amount of the working constituent is disproportionately large, it may not flow out with the wax when the wax is melted out, and contaminate the part.

In light of these considerations, in an embodiment, the susceptor 200 may be formed by embedding the working constituent (WC) in the base constituent (BC) set forth in Table 1.

TABLE 1

Constitution of example susceptor 200

| Working Constituent (WC) | Particle shape | Coercivity Hc (Oersted, VSM) | D10 nm | D50 nm | D90 nm | Base Constituent (BC) | % loading of WC in BC |
|---|---|---|---|---|---|---|---|
| sun high purity magnetite B2310 | spherical | ~85-120 | 280 | 576 | 899 | StickTite ® | 8% |

The magnetite may be embedded in the StickTite by blending or other means. A susceptor 200 so formed may fully melt when a 250A current is applied for 30 seconds and exhibit superb flow characteristics. Of course, other suitable working constituents and base constituents may additionally or alternately be utilized to form the susceptor 200. The ability to vary the power supplied to the inductor as desired may allow the bond interfaces to be granularly controlled.

Susceptor shape and size, and joint geometry, may also be driven by one or more of the factors driving the constitution of the susceptor 200. For example, due to contamination concerns, when the male component (e.g., the runner 114) is rotated to mate with the female component (e.g., the depression 111 of the wax pattern 110), the susceptor 200 may take up a majority, but less than all, of the space in the interface (e.g., the susceptor 200 may cover a majority of the space in the interface between the runner 114 and the depression 111 but some space may be left exposed). Such may facilitate the complete removal of the susceptor upon the melting of the wax components, thereby reducing the likelihood of contamination. The artisan will understand that the size and shape of the susceptor 200 may vary based on other considerations, e.g., the strength of the required bond, the size of the part(s) being coupled, et cetera.

As described above, joints La, Lb, Lc, and Ld may be completed by inductively heating the susceptor 200. Use of the susceptor 200 in the formation of joints Le between the wax blade 112 and the plate 108, however, may not be recommendable. Because of the direction of flow of the wax when the wax is melted out of the feeder system 100, including a susceptor 200 below the wax pattern 110 would mean that the working material of the susceptor 200 would have to flow all the way back out through the assembly 100. This may increase the likelihood that some working material may be left behind and contaminate the part being cast. To avoid such contamination, a sacrificial wax component may be set below the wax blade 112 and a steel or iron nugget may be incorporated in the plate 108 (e.g., may be formed therein or otherwise permanently coupled thereto). The nugget may be heated inductively to cause it to melt the sacrificial wax component, and thereby result in a bond between the wax blade 112 and the plate 108. Forming the joints Le without a susceptor may thus reduce contamination chances.

As noted, one of the benefits of the various described embodiments, e.g., of the susceptors 200 of the assembly 100, may be that they may facilitate repeatability by replacing the manual labor the technician otherwise has to perform to attempt to ensure the continuity of the joints. In embodiments, the entire process of assembling the wax components (i.e., the wax patterns 110, wax blades 112, runners 114, and supports 116) onto the assembly 100 may be automated. Such may further reduce the labor costs involved in assembling the wax components on the feeder system 100 and drastically reduce cycle time and part rejections.

Figure 7:
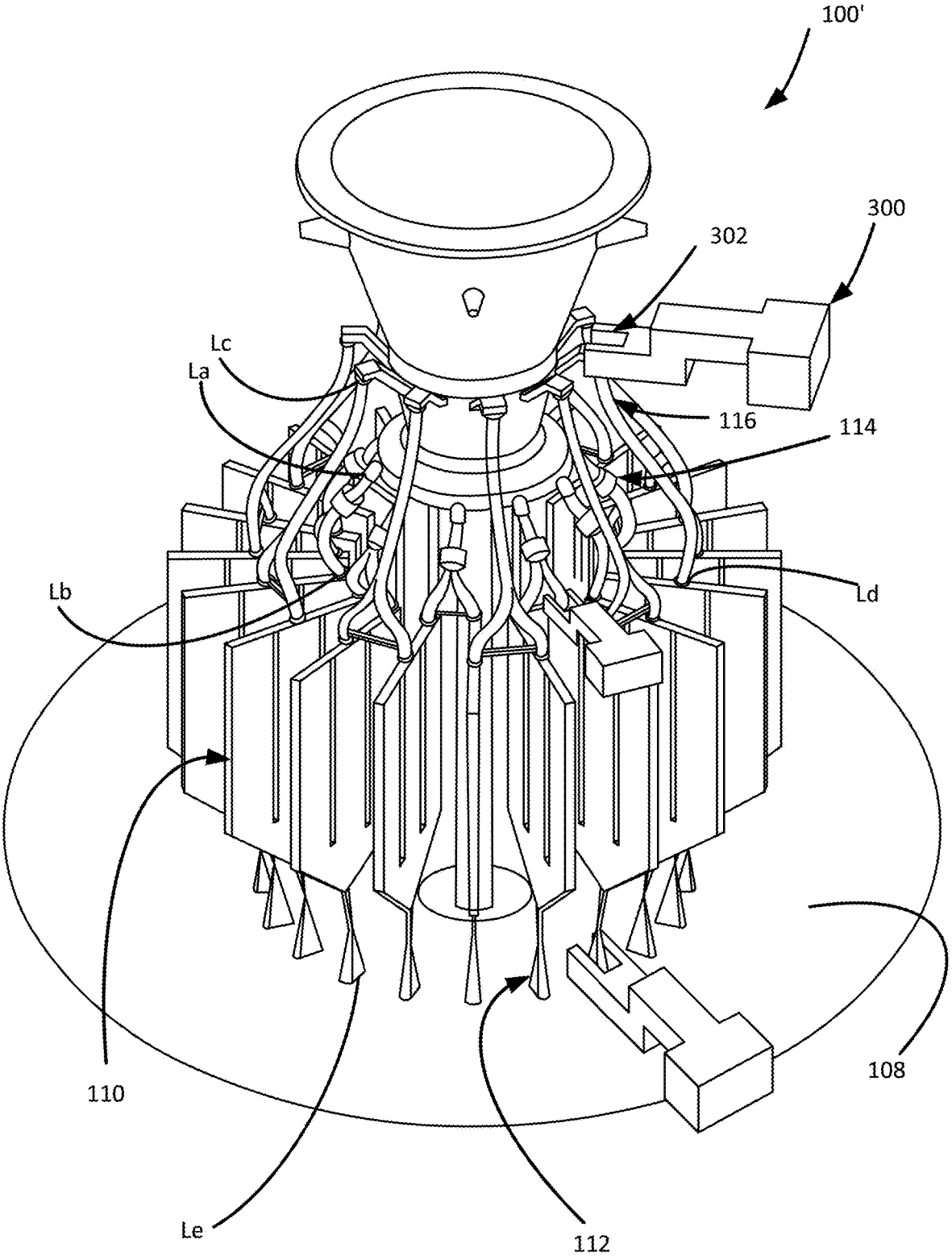
FIG. 7 is a perspective view of the feeder system of FIG. 3 showing certain joints thereof being inductively heated using an automated process.

FIG. 7 shows a feeder system 100'. Feeder system 100' is substantially similar to the feeder system 100, except as expressly noted and/or shown, or would be inherent. Corresponding references may be used to denote corresponding parts.

The primary difference between the feeder system 100 and the feeder system 100' is that the joints La, Lb, Lc, Ld, and Le of the feeder system 100' are not complete (i.e., are in the process of being inductively heated to complete the formation of these joints).

In more detail, in an example embodiment the base 108 may be mounted on a 2-axis or like positioner. A robot may configure one wax pattern 110 and wax blade 112 on the feeder system 100', and another robot or set of robots may configure one or more runners 114 and supports 116 associated therewith. Once this set is complete, the base 108 may be rotated, and the robots may configure the next set of the wax patterns 110 and wax blades 112, runners 114, and supports 116. The base 108 may be continuously rotated in this fashion until each wax pattern 110, wax blade 112, runner 114, and support 116 have been configured on the feeder system 100.

Next, robots, such as the robot 300, may inductively heat susceptors to form the joints La, Lb, Lc, and Ld. Each robot 300 may include an inductor coil 302, such as an open coil with flux concentrators or another suitably configured coil, that may inductively heat the susceptor 200 to form the joint. For example, one robot 300 may inductively heat the susceptor associated with joint La (not expressly shown in FIG. 7 for clarity), one robot 300 may inductively heat the susceptor associated with joint Lc, one robot 300 may inductively heat the susceptors associated with joints Lb and Ld, and another robot may inductively heat the susceptorless joint Le. Once a set of joints is finalized, the base 108 may be rotated and the robot 300 may inductively heat the next set of joints, and so on, until all the joints La, Lb, Lc, Ld, and Le are completed. Alternatively, the robot 300 may shift or rotate to an adjacent susceptor 200 to continue the wax bonding process. In an alternate configuration, multiple robots 300 may bond multiple susceptors 200 simultaneously so as to further expedite the process. The feeder system may then be dipped in a slurry to form the shell, as discussed above.

Thus, as has been described, inductively heating the joints (using, e.g., a susceptor 200) may allow for repeatable joints for bonding wax components to be formed and may facilitate the automation of one or more processes for casting a metal part. While the disclosure focuses on heating the susceptor 200 inductively, the artisan will understand that other non-contact heating methods may likewise be employed. For example, microwaves may be used to heat the susceptor 200 and resultantly form the bond. However, due to safety and other considerations, inductive heating may, in embodiments, be preferable to heating the susceptor 200 using microwaves.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations. Not all steps listed in the various figures need be carried out in the specific order described.

The disclosure claimed is:

1. A method for bonding a wax component in a feeder system, the method comprising:

embedding nano-particles in wax to form a sacrificial susceptor;

coupling the wax component to another component such that the sacrificial susceptor is at an interface of the wax component and the other component; and heating the sacrificial susceptor to cause the wax of the sacrificial susceptor and at least a portion of wax of the wax component to melt to form a bond between the wax component and the other component.

2. The method of claim 1, wherein the heating includes one of inductive heating or using microwaves.

3. The method of claim 2, wherein the interface is a tapered depression, further including rotating the wax component within the tapered depression.

4. The method of claim 1, wherein the heating includes inductively heating the sacrificial susceptor using a robotic system.

5. The method of claim 4, wherein the robotic system includes a 2-axis positioner.

6. The method of claim 1, wherein the wax component is a runner.

7. The method of claim 1, wherein the wax component is a support.

8. The method of claim 1, wherein the sacrificial susceptor includes magnetite.

9. The method of claim 8, wherein particles of the magnetite include a spherical shape.

10. The method of claim 9, wherein the other component is part of the feeder system.

11. A method for bonding a wax component in a feeder system for a lost wax casting process, comprising:

embedding conductive particles in wax to form a sacrificial susceptor;

coupling the wax component to another component such that the sacrificial susceptor is at an interface of the wax component and the other component; and heating the sacrificial susceptor to cause the wax of the sacrificial susceptor and at least a portion of wax of the wax component to melt to form a bond between the wax component and the other component.

12. The method of claim 11, wherein the heating includes inductive heating or using microwaves.

13. The method of claim 12, further including locating the sacrificial susceptor in a depression integral with the other component.

14. The method of claim 12, further including locating the sacrificial susceptor in a depression, the depression being integral with the wax component.

15. The method of claim 11, wherein loading of the sacrificial susceptor is about 8% loading.

16. The method of claim 11, wherein the embedding includes a blending process.

17. A wax casting system for bonding a wax component in a feeder system, the wax casting system comprising:

a plurality of sacrificial susceptors each including nano-particles embedded in wax;

a plurality of runners and supports, each of the plurality of runners and supports coupled to the feeder system; and an inductive heating system;

wherein, each of the plurality of runners and supports corresponds to and is associated with at least one of the plurality of sacrificial susceptors.

18. The wax casting system of claim 17, further including a plurality of wax blades.

19. The wax casting system of claim 18, wherein the feeder system includes a feeding cup and a base plate.

20. The wax casting system of claim 19, wherein at least a portion of the nano-particles are conductive nano-particles and at least one of the plurality of sacrificial susceptors includes magnetite.

* * * * *